United States Patent [19]

Lepisto

[11] 4,391,310

[45] Jul. 5, 1983

[54] BAG FILLER SPOUT

[75] Inventor: J. George Lepisto, Middletown, Ohio

[73] Assignee: Champion International Corporation, Stamford, Conn.

[21] Appl. No.: 304,358

[22] Filed: Sep. 22, 1981

[51] Int. Cl.[3] ..... B65B 1/18

[52] U.S. Cl. ..... 141/286; 141/392; 141/68

[58] Field of Search ..... 141/313, 314, 315, 316, 141/317, 392, 285, 286, 67, 68, 114, 59; 137/846; 229/62 S; 150/9

[56] References Cited

U.S. PATENT DOCUMENTS 2,012,116 8/1935 Andreas ..... 141/68

*Primary Examiner*—Houston S. Bell

*Attorney, Agent, or Firm*—Evelyn M. Sommer

[57] ABSTRACT

A filler spout for attachment to an automatic bag filling machine whereby freely flowable material is forceably driven through the spout into the interior of the bag. The spout is inserted through an entry opening in the side of the bag during the filling operation. During the filling operation both ends of the bag are sealed. The spout comprises an outer shroud portion inside of which a material delivery tube is disposed. The end of the shroud which is inserted into the bag is closed with a blunt curvilinear contour for easy insertion. An opening is disposed in the side of the shroud adjacent the closed blunt end, and the bore of the delivery tube communicates with the opening in the side of the shroud. The delivery tube has a curvilinear axis so that material fed through the delivery tube is deflected down into the interior of the bag toward one of the sealed ends so as to minimize damage to the side walls.

3 Claims, 3 Drawing Figures

BAG FILLER SPOUT

This invention relates to an improved filler spout for use in connection with automatic bag filling machinery. More particularly, this invention relates to an improved filler spout which minimizes material blowback through the filler entry opening formed in the bag.

Multi-wall bags are used to hold many different kinds of flowable material, such as granular, flake, or powdered material. These bags are conventionally formed with both ends sealed before they are filled with the material which they contain. In order to fill the bags they are provided with closeable entry openings, usually in one of the corners adjacent one of the sealed ends. Automatic filling machinery is used, the machinery holding a bulk supply of the material to be put in the bags, and the machinery including a filler spout which is inserted into the bag via the entry opening. The material is blown or otherwise impelled from the bulk supply through the filler spout and into the bag until the bag is filled. Once the bag is filled, the material impeller in the filling machine is interrupted and the filler spout is withdrawn from the entry opening in the bag, and the entry opening is closed. The filler spouts which are conventionally used employ a linear material delivery bore so that the material is impelled into the bag through the entry opening in one of the corners whereupon the impelled material strikes the opposite side wall before falling into the bottom of the bag. With certain types of entry openings, this method of delivery of the material into the bag has proven to be less than satisfactory because the impelled material can rebound off of the opposite corner and cause damage to the paper plys.

This invention affords a solution to the problem of bag breakage by providing a filler spout which has a delivery tube which is bent downward so that the impelled material is directed immediately toward the bottom of the bag, rather than against the opposite corner, when the material leaves the filler spout. The filler spout of this invention includes an outer generally straight line tubular shroud member which has a hollow bore. The shroud has one open end which is adapted to be positioned adjacent to the filler machine, and the opposite end of the shroud, i.e. the end which is inserted into the bag, is closed and has a blunt, curvilinear outer configuration. An opening is formed in the side wall of the shroud a short distance from the closed end thereof. Inside of the shroud there is disposed a material delivery tube. The delivery tube has an open inlet end which extends outwardly beyond the open end of the shroud and is adapted to be connected to the filler machine in order that the product to be packaged can be impelled through the delivery tube. The delivery tube also has an open outlet end which is disposed coextant with the outlet opening in the side wall of the shroud. The axis of the delivery tube is curvilinear, or bent, within the shroud. The interior of the shroud around the delivery tube is open so as to serve as a passage for venting air out of the bag as the latter is filled with material. A vent port is disposed in the shroud wall for this purpose. Thus the stream of material impelled from the filler machine into the delivery tube is deflected due to the curvature of the delivery tube axis so that the material, after leaving the filler spout, is impelled toward the closed bottom of the bag rather than toward the opposite side wall of the bag.

It is, therefore, an object of this invention to provide a filler spout for use in connection with automatic filling machinery, which spout is operative to direct a stream of flowable material into a closed end bag through a filler entry in the bag.

It is an additional object of this invention to provide a filler spout of the character described wherein the material being delivered into the bag is directed toward a closed end of the bag.

It is a further object of this invention to provide a filler spout of the character described which includes a shielded venting passage for venting air from a bag during the filling operation.

These and other objects and advantages of the invention will become more readily apparent from the following detailed description of a preferred embodiment thereof, taken in conjunction with the accompanying drawings, in which.

Figure 1:
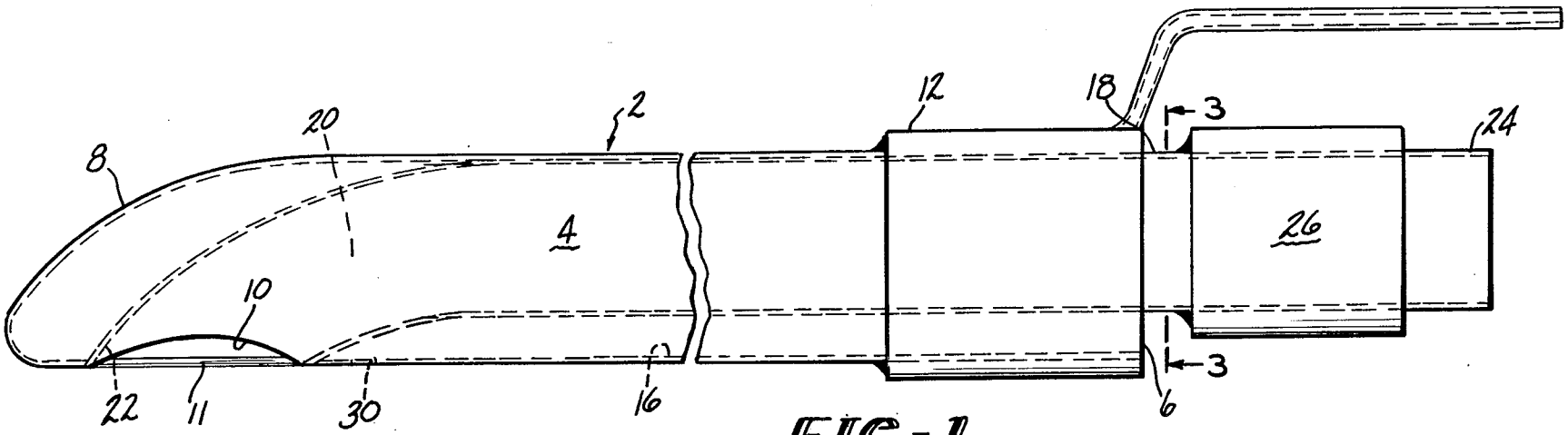
FIG. 1 is a side elevational view of a preferred embodiment of a filler spout formed in accordance with this invention.

Referring now to the drawings, there is shown in FIG. 1 a preferred embodiment of a filler spout, denoted generally by the numeral 2, formed in accordance with this invention. The spout 2 includes an outer shroud member 4 which is generally tubular in configuration. The shroud 4 has an open end 6 and a blunt curvilinear closed end 8. A discharge opening 10 is disposed in the side wall of the shroud 4 in the vicinity of the blunt end 8. A rod may be disposed spanning the discharge opening 10 to prevent the bag from catching on the curved opening. It will be understood that the blunt end 8 of the shroud 4 is the end which is inserted into the bag during the filling operation. A collar 12 is fitted onto the shroud 4 about the open end 6. Disposed within the bore 16 of the shroud 4 is a material delivery tube 18. The delivery tube 18 has its axis bent as at 20 within the shroud 4 and has an outlet end 22 which opens to the discharge opening 10 of the shroud 4. The outlet end 22 of the delivery tube 18 is fixed to the shroud 4 as by welding, brazing, or the like. The delivery tube 18 also has an inlet end 24 which projects beyond the open end 6 of the shroud 4 and is adapted to be telescopingly received in the material impelling machine (not shown). A collar stop 26 is fitted onto the delivery tube 18 near the inlet end 24 thereof.

Figure 2:
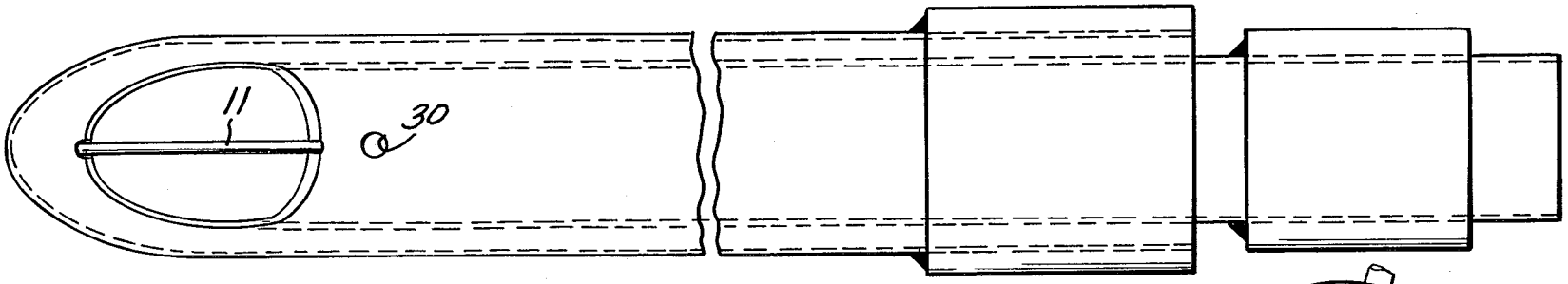
FIG. 2 is a bottom view of the filler spout of FIG. 1.
Figure 3:
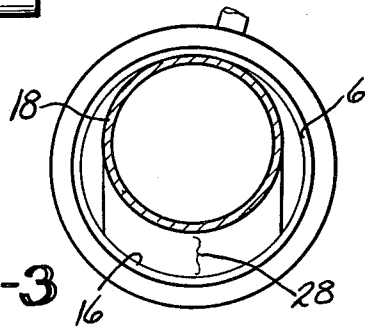
FIG. 3 is a sectional view of the filler spout taken along line 3—3 of FIG. 1.

It will be noted that there is a free space 28 between the shroud bore 16 and the delivery tube 18 (see FIG. 3) which free space 28 is utilized to exhaust air from the bag during the filling operation. An exhaust port 30 is provided in the shroud 4 which port 30 communicates with the free space 28 to allow entry of the exhaust air into the shroud bore 16, as shown in FIGS. 2 and 3.

The feeder spout 2 operates as follows. The inlet end 24 of the delivery tube 18 is fitted into the material impelling machine. The spout 2 will then protrude from the material impelling machine so that the spout 2 can be inserted into the filling entries of bags which are fed past the machine. When the spout 2 is inserted into a bag, the discharge opening 10 will point toward a closed end of the bag most remote from the filling entry of the bag. The curvilinear blunt end 8 of the shroud 4 facilitates easy insertion of the spout 2 into the filling entry of the bags. When inserted into the bag, the discharge opening 10 and the exhaust port 30 will both be within the confines of the bag. When the material is impelled through the spout 2, the stream of moving material will be deflected by the delivery tube 18 from a horizontal path to a substantially vertical path by the time the material stream exits from the discharge opening 10. Thus the stream of material entering the bag is directed toward the closed end of the bag remote from the filling entry so as to minimize the amount of material which will blow back out of the bag through the filling entry around the spout. It will be appreciated that as the bag fills up with material, the air in the bag will be exhausted therefrom through the interior of the shroud and into the ambient surroundings via the open end of the shroud.

It will be readily appreciated that the filler spout of this invention is of simple construction, and will be operative to efficiently deliver the flowable product to the bag with a minimum of the product being blown back out of the bag through the filler entry. The spout also provides for efficient exhausting of the air in the bag during the filling operation.

Since many changes and variations of the disclosed embodiment of the invention may be made without departing from the inventive concept, it is not intended to limit the invention otherwise than as required by the appended claims.

What is claimed is:

1. A filler spout for use in feeding a stream of flowable material into a closed end multi-wall bag to facilitate insertion of the spout into the bag without damaging the inner wall thereof, and to ensure a constant volume passage for exhaust from the bag as the bag is filled by the flowable material, said spout comprising:

(a) an outer tubular shroud member having a blunt curvilinear closed end and an opposite open end, an exhaust port formed in the side wall of the shroud member, and a discharge opening formed in the side wall of said shroud member intermediate said blunt curvilinear closed end and said exhaust port; and (b) an open ended material delivery tube disposed within the bore of said shroud member and spaced from the wall thereof so as to define an exhaust passage, one end of said exhaust passage being in communication with said exhaust port and the other end of said exhaust passage opening to ambient surroundings through the open end of said shroud member, said delivery tube having an inlet end adapted for connection with a material impelling machine, and an outlet end disposed contiguous to said discharge opening of said shroud member, said inlet end of said delivery tube projecting outwardly beyond said open end of said shroud member, said delivery tube having a first straight line portion extending from said inlet end into said shroud member and a second curvilinear portion extending from said first portion to said outlet end, said delivery tube being operable to divert the direction of a stream of material impelled therethrough approximately 90° from said inlet end to said outlet end whereby said exhaust passage is maintained at a constant volume by said shroud member and whereby said closed curvilinear blunt end of said shroud facilitates entry of the spout into the bag without damaging the inner wall thereof.

2. A filler spout as in claim 1 wherein said shroud is formed from a noncollapsible material.

3. A filler spout as in claim 1 further comprising a guide rod spanning the outlet end of said material delivery tube, whereby said guide rod prevents the outlet end of said material delivery tube from damaging the bag upon insertion of the filler spout into the bag.

* * * * *